US005954547A

United States Patent [19]

Auclair

[11] Patent Number: 5,954,547

[45] **Date of Patent: *Sep. 21, 1999**

[54] LOW COST STRAIN RELIEF DEVICE FOR CLAMP ASSEMBLY

[75] Inventor: John W. Auclair, Norfolk, Conn.

[73] Assignee: Electric Motion Company, Inc., Winsted, Conn.

[ * ] Notice: This patent is subject to a terminal disclaimer.

[21] Appl. No.: 08/959,368

[22] Filed: Oct. 28, 1997

[51] Int. Cl.[6] ..... H01R 13/648

[52] U.S. Cl. ..... 439/793; 439/812; 439/98

[58] Field of Search ..... 439/793, 98, 812, 439/810, 811

[56] References Cited

U.S. PATENT DOCUMENTS

| | | |
|---|---|---|
| 822,492 | 6/1906 | Turner . |
| 1,677,783 | 7/1928 | Kearney . |
| 1,993,391 | 3/1935 | Weaver, Jr. . |
| 2,006,794 | 7/1935 | Davidson . |
| 2,088,414 | 7/1937 | Heinrich . |
| 2,088,481 | 7/1937 | Mylius . |
| 2,135,623 | 11/1938 | Peirce, Jr. . |
| 2,137,834 | 11/1938 | Dibner . |
| 2,150,994 | 3/1939 | Tallman . |
| 2,197,000 | 4/1940 | MacLean . |
| 2,576,527 | 11/1951 | Matthysse . |
| 2,693,587 | 11/1954 | Davidson . |
| 2,812,963 | 11/1957 | Johansson . |
| 3,093,435 | 6/1963 | Johnson . |
| 3,260,987 | 7/1966 | Gunthel, Jr. . |
| 3,544,955 | 12/1970 | Ruiz . |
| 4,842,530 | 6/1989 | Erickson, II et al. . |
| 5,021,014 | 6/1991 | Walter et al. . |
| 5,429,532 | 7/1995 | Auclair . |
| 5,679,032 | 10/1997 | Auclair ..... 439/773 |

FOREIGN PATENT DOCUMENTS

| | | |
|---|---|---|
| 525849 | 6/1956 | Canada . |
| 841831 | 5/1939 | France . |
| 53 374 | 10/1945 | France . |
| 1 098 753 | 3/1955 | France . |
| 728 658 | 12/1942 | Germany . |
| 895 016 | 10/1953 | Germany . |
| 938 555 | 2/1956 | Germany . |
| 675732 | 7/1952 | United Kingdom . |
| 2 111 764 | 7/1983 | United Kingdom . |

*Primary Examiner*—Paula Bradley
*Assistant Examiner*—Alexander Gilma
*Attorney, Agent, or Firm*—Alix, Yale & Ristas, LLP

[57] ABSTRACT

A ground clamp for clamping to a cable shield to provide a ground connection employs a yoke member having a U-shaped yoke section, a rigid ground section and a strain relief section. The yoke member is molded as an integral unit, eliminating all machining/stamping operations from its manufacture. A relatively inexpensive zinc alloy is used in the manufacture of the yoke member, eliminating the use of relatively expensive bronze and copper. A keeper has a driver which threadably engages thread surfaces at the interior side of the yoke legs. The keeper has a clamp jaw which may be compressively engaged against a cable shield received in an aperture defined by the yoke. Electrical tape, tie-wraps, or similar devices mechanically connect the strain relief section of the yoke member to the cable outer jacket to relieve strain on the cable conductive sheath.

19 Claims, 3 Drawing Sheets

LOW COST STRAIN RELIEF DEVICE FOR CLAMP ASSEMBLY

BACKGROUND OF THE INVENTION

This invention relates generally to devices for implementing a ground connection between a metallic shield of a cable and a common ground point. More particularly, the present invention relates generally to clamp devices which mount to service cables and connect with a common ground point.

A number of various types of devices have been employed for connecting a ground wire with the tubular ground shields of service wires. Most conventional devices employ clamp assemblies of various forms. In applications to which the present invention relates, the connecting devices are ordinarily positioned within a cabinet, housing or other enclosure, hereafter collectively termed "enclosure", to provide a grounding connection between the metallic shield of the service cable and a common ground point. Frequently, there is a minimal amount of available space within the enclosures for such ground connecting devices.

A number of conventional designs are configured to mount rigidly or semi-rigidly within the enclosures. Such conventional designs typically utilize a plurality of individual components which must be individually manufactured and assembled. Generally, such conventional designs utilize copper/tin plated steel, bronze and/or copper for the various components, depending on the strength and/or electrical properties required. Although each individual grounding device contains only a small amount of each of these materials, the relative costs of some these materials can have a significant impact on the market price of the grounding device. In addition, such devices typically clamp directly to the cable shield. Such shields are not generally designed as strength members and are easily damaged by forces transmitted to the shield by the cable clamp. Furthermore, such forces are generally concentrated along the edge of the cable clamp. Consequently, relatively minor forces may cause shearing of the cable shield.

U.S. patent application Ser. No. 08/576,446 discloses one type of cable clamp to which the present invention generally relates. The clamp has a stamped metal U-shaped body portion or yoke. A keeper threadably engages thread surfaces at the interior side of the yoke legs. The keeper has a clamp jaw which may be compressively engaged against a cable shield received in an aperture defined by the yoke. The yoke connects to a common ground point via a flexible ground wire connection or a rigid ground connection which is mounted to the yoke by a screw or rivet. A bracing portion of the rigid ground connection includes two arms which may be crimped into engagement with the cable outer jacket to relieve strain on the cable conductive sheath. Although such cable clamp is an improvement over the conventional devices, the rigid ground connection is generally composed of relatively expensive brass to provide the proper mechanical and electrical properties. Although the use of a separate rigid ground connection, yoke, and screw/rivet provides flexibility of manufacture, such separate components are relatively expensive to manufacture and assemble into a finished product.

SUMMARY OF THE INVENTION

Briefly stated, the invention in a preferred form is a cable shield ground clamp having an integral molded yoke member. The yoke member comprises a generally U-shaped yoke section and ground connection and strain relief sections which extend laterally from the yoke section. The yoke section includes a pair of generally parallel legs which have opposed molded thread surfaces. A keeper is threadable with the thread surfaces of the yoke and torquable for displacement relative to the yoke. The keeper includes a clamp jaw which is compressively engageable against a service wire ground shield received between the legs of the yoke section. The strain relief section may be mounted to the cable jacket to relieve the strain on the cable shield.

The yoke member is an integral unit preferably cast from zinc alloy. The yoke member configuration and molding process eliminate the need for machining and/or stamping processes required by conventional clamps. The integral design also provides superior conductive characteristics since it eliminates the possibility of the formation of a high impedance joint. The all zinc construction eliminates the use of all brass, resulting in lower material costs.

Electrical tape, tie-wraps or the like may be used to mechanically couple the strain relief section to the cable jacket. Mechanical forces such as movement of the cable or cable tension are preferably transmitted to the clamp assembly via the cable jacket and cable jacket clamp, thereby reducing or eliminating the force that is imposed on the cable shield.

An object of the invention is to provide a new and improved cable shield ground clamp for implementing a ground connection between the metallic shield of a service cable and a common ground point.

Another object of the invention is to provide a new and improved cable shield ground clamp which is composed of materials that are less expensive than those used in conventional devices and which is manufactured in a manner that are less expensive than that utilized to manufacture conventional devices.

A further object of the invention is to provide a new and improved cable shield ground clamp which bonds with a shielded cable in a manner which provides superior mechanical strength by preferentially applying strain and tension to the cable jacket instead of the cable shield.

Other objects and advantages of the invention will become apparent from the specification and the drawings.

DETAILED DESCRIPTION OF THE PREFERRED EMBODIMENT

Figure 1:
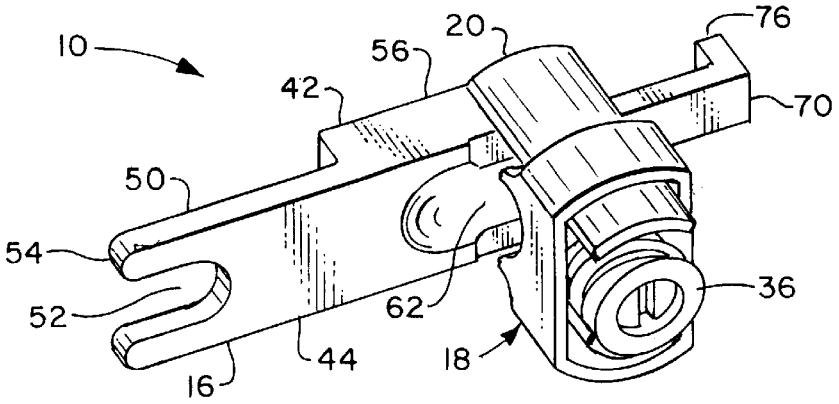
FIG. 1 is a perspective view of a cable shield ground clamp in accordance with the present invention.
Figure 2:
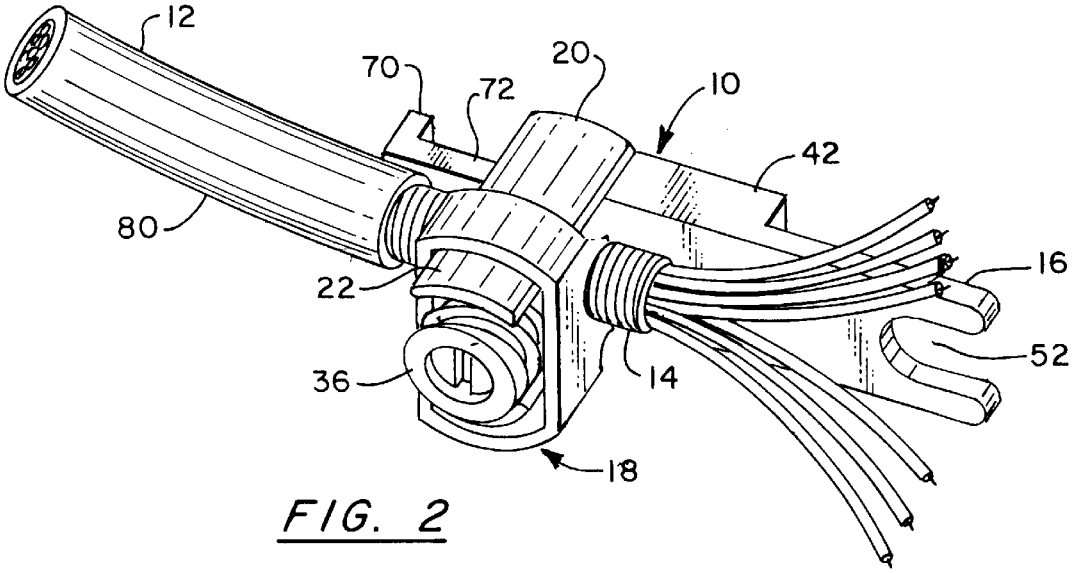
FIG. 2 is a perspective view of the cable shield ground clamp of FIG. 1 together with a service cable.

With reference to the drawings wherein like numerals represent like parts throughout the Figures, a cable shield ground clamp in accordance with the present invention is generally designated by the numeral 10. The clamp 10 is particularly adapted for receiving one or more service wires or cables 12 and connecting the tubular metallic shields 14 of the wires to a common ground point. The cable shield ground clamp 10 is adapted for use in an enclosure (not shown), such as a network interface device (NID), pedestal or other housing, and comprises an integral yoke member 16 for receiving the cable 12 and a keeper 18 for clamping the cable 12 within the yoke member.

Figure 3:
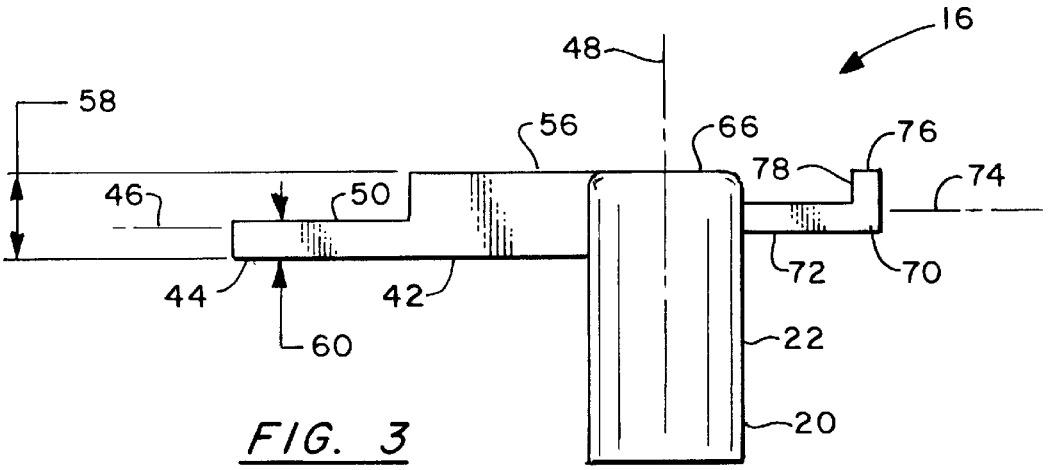
FIG. 3 is a side view of the cable shield ground clamp of FIG. 1.
Figure 4:
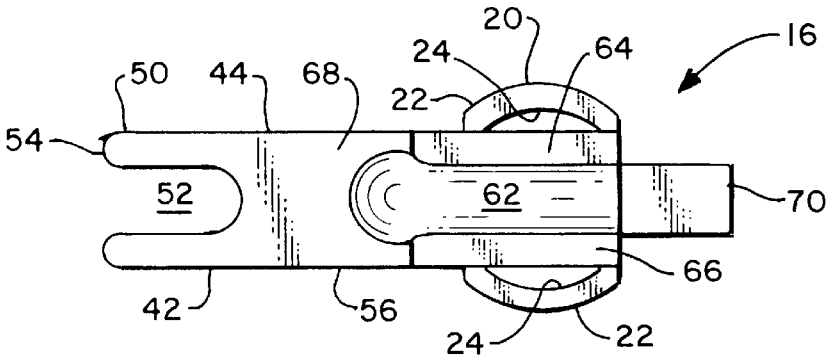
FIG. 4 is a bottom view of the cable shield ground clamp of FIG. 1.
Figure 5:
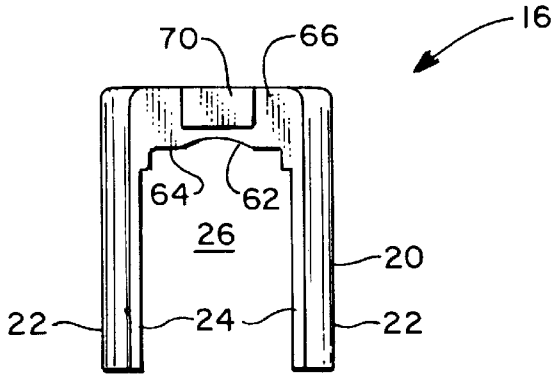
FIG. 5 is an end view of the yoke member of FIG. 3.

With reference to FIGS. 3–5, the yoke member 16 comprises a generally U-shaped yoke section 20 having generally parallel legs 22. The legs 22 of the yoke section 20 have respective opposed inwardly disposed thread surfaces 24. A receiving aperture 26 is generally formed at the upper inward portion of the yoke section 20 for receiving one or more service wire ground shields.

Figure 6:
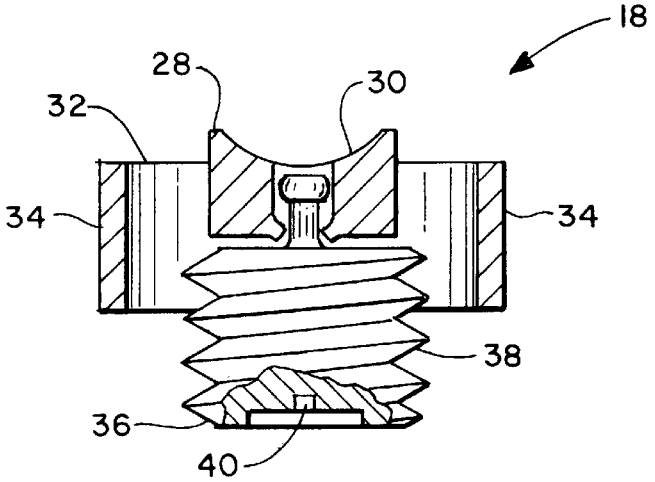
FIG. 6 is a frontal sectional view of the keeper for the cable shield ground clamp of FIG. 1.

The ground shields 14 are compressively secured to the clamp 10 by means of the keeper 18 which is slidably displaceable and selectively fixedly positionable along the legs 22 of the yoke section 20. As shown in FIG. 6, the keeper 18 includes an upper clamp jaw 28 which in a preferred form has a laterally extending U-shaped recess or groove 30. The groove 30 enhances surface contact with the ground shield 14 and provides a more intimate clamping engagement. The body 32 of the keeper 18 includes a pair of integral guide skirts 34. The guide skirts 34 form axial openings which are dimensioned to be greater than the sections of the legs 22 of the yoke section 20 to permit sliding displacement relative thereto. The guide skirts 34 also function to limit lateral separation between the legs 22 of the yoke section 20 which are generally parallel regardless of the position of the keeper 18.

The position and displacement of the keeper 18 is governed by a threaded driver 36. The threaded driver 36 is rotatably mounted at the underside of the clamp jaw 28. The driver 36 has a helical threaded surface 38 which is dimensioned for threading engagement with the complementary thread surfaces 24 of the yoke section 20. The underside of the driver 36 includes a recessed slot 40 which is dimensioned to receive a blade of a screwdriver or similar tool for torquing the driver. The recess walls retain the blade as it rotates. Alternately, the slot may not be recessed. The driver 36 threadably engages the surface 24 of the yoke section 20 and is threadably displaceable along the legs 22 of the yoke section 20 for selectively compressively clamping the jaw 28 against a received ground shield 14. The clamp engagement with the ground shield 14 is maintained by the threaded engagement between the driver 36 and the yoke section 20 which is also laterally reinforced by the guide skirts 34.

The open ended design for clamp 10 allows the keeper 18 to be completely dismounted from the yoke section 20 so that the clamp 10 may be installed onto a cable 12 which is already in service. In addition, the clamp 10 may be disassembled, i.e., the keeper 18 disengaged from the yoke section 20, to isolate the ground.

With further reference to FIGS. 3 and 4, the yoke member 16 also comprises a grounding section 42 for mounting the clamp 10 to a common ground. Preferably, the grounding section 42 comprises a laterally extending arm 44 having an axis 46 that is substantially perpendicular to the axis 48 of the yoke section 20, as shown in FIG. 3. The arm 44 comprises a distal portion 50 having a slot 52 laterally extending from the distal tip 54 for receiving a mounting screw or similar mounting means. An intermediate portion 56 of the arm 44 is disposed between the distal portion 50 and the yoke section 20. Preferably, the thickness 58 of the intermediate portion 50 is greater than the thickness 60 of the distal portion 50. The relatively thin distal portion 50 facilitates the mounting of the clamp 10. As shown in FIGS. 4 and 5, the relatively thick intermediate portion 56 allows a laterally extending U-shaped recess or groove 62 to be formed in the inner surface 64 of the yoke bight 66 and the adjacent surface 68 of a part of the intermediate portion 56 without a reduction in the mechanical strength of the yoke member 20. The groove 62 enhances surface contact with the ground shield 14 and provides a more intimate clamping engagement.

Figure 7:
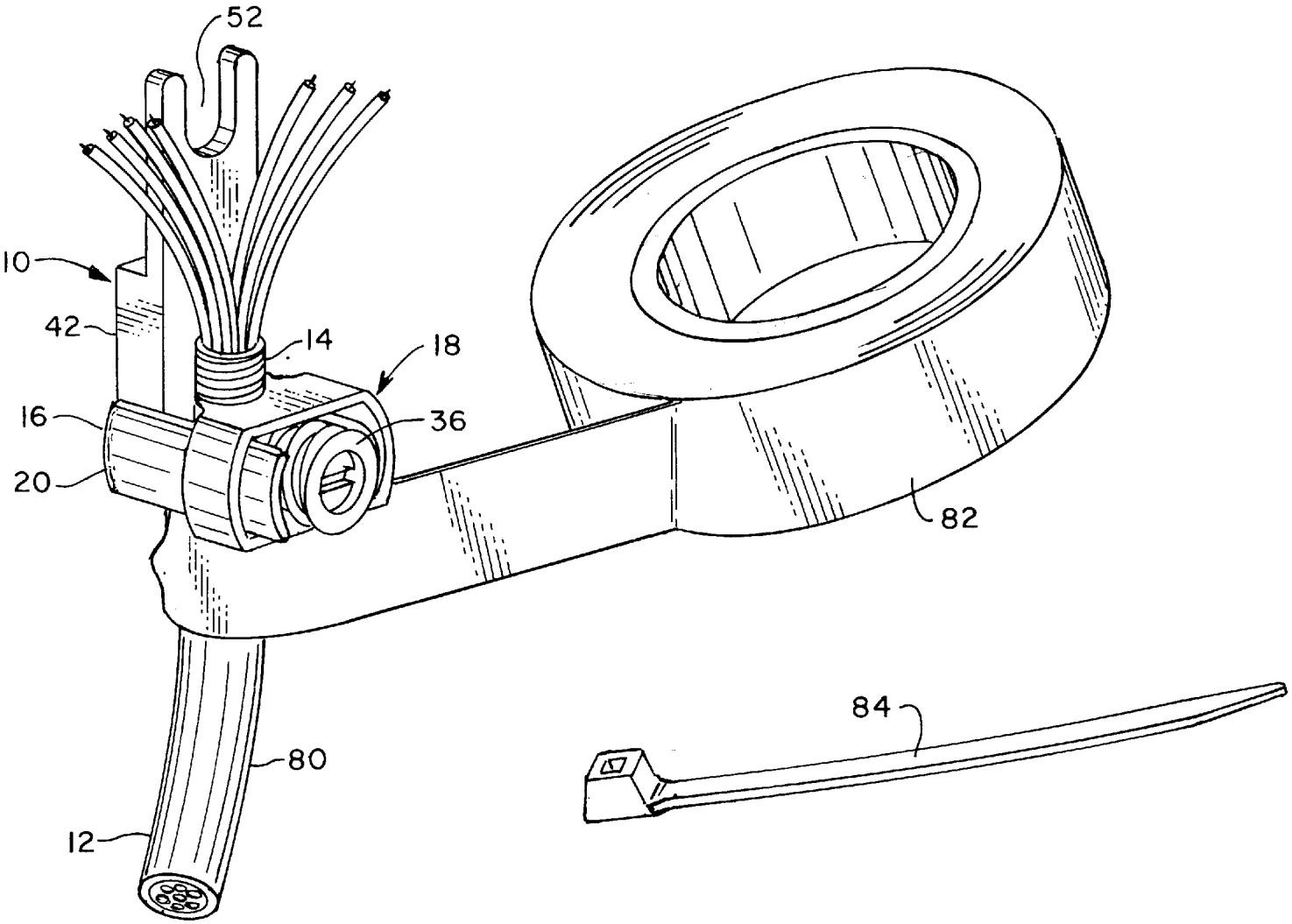
FIG. 7 is a perspective view of the cable shield ground clamp of FIG. 1 together with a service cable and electrical tape for mounting the service cable to the strain relief.

As described above and particularly with reference to FIG. 3, the grounding section 42 preferably has an axis 46 that is substantially perpendicular to the axis 48 of the yoke section 20. However, it should be appreciated that the grounding section may be formed into a variety of configurations to facilitate mounting to the ground. The grounding section of the subject invention may comprises three segments (not shown) where the first segment extends from the yoke section, the second segment extends from the first segment, and the third or mounting segment extends from the second segment. The segments extend at an angle from each other such that the mounting segment lies on a plane which is offset from the plane of the first segment. Such grounding sections are shown in FIGS. 6–8 of U.S. patent application Ser. No. 08/576,446, which is assigned to the assignee of the subject application and which is hereby incorporated by reference.

The yoke member 16 further comprises a strain relief section 70. Preferably, the strain relief section 70 comprises a laterally extending shelf 72 having an axis 74 that is substantially perpendicular to the axis 48 of the yoke section 20, as shown in FIG. 3. The distal end portion 76 of the strain relief section 70 extends longitudinally upward to define a shoulder 78. Electrical tape 82, tie-wraps 84, or similar means may be used to mount the strain relief section 70 to the cable jacket 80, as shown in FIG. 7. The electrical tape 82, tie-wrap 84, or other mounting means engages the cable jacket 80 at a position which is longitudinally spaced from the position where the keeper 18 engages the cable shield 14. Mechanical forces such as movement of the cable 12 or cable tension are therefore preferentially transmitted to the clamp assembly 10 via the cable jacket 80 and cable jacket mounting means 82, 84, reducing or eliminating the force that is imposed on the cable shield 14. The shoulder 78 prevents the electrical tape 82, tie-wrap 84, or other mounting means from slipping off the distal end of the strain relief section 70.

The ground clamp 10 has particular applicability for service wires which terminate in a network interface device such as an IDC/GelGuard™ device. The ground clamp 10 is also applicable for buried service wire use. The service wires 12 are connected by initially exposing approximately one-half inch of the ground shield 14. The service wire and ground shield 14 are inserted into the receiving aperture 26. The keeper jaw 28 is compressively tightened against the shield 14 upon insertion of a screwdriver blade into the slot 40 and torquing the screwdriver. Electrical tape 82, tie-wrap 84, or other mounting means is wrapped around the strain relief section 70 and the cable jacket 80 as described above. The legs 22 may have indentations that facilitate removal of the distal portions of the legs.

The yoke member 16 and keeper 18 typically have a zinc alloy with copper/tin plated composition. The yoke member 16 is an integral cast structure. The yoke member mold produces all of the details of the yoke member structures shown in the Figures and described above, including the threaded surfaces 24 on the yoke section legs 22. Conventional ground clamps typically have threaded surfaces that are formed by a machining process, which is relatively expensive. The thread surfaces on the yoke of U.S. patent application Ser. No. 08/576,446 are formed during the stamping process that forms the yoke. The use of a molding process eliminates the need for either a machining process or a stamping process and thereby reduces expense. Given the material requirements and space constraints for the finished product, it had been expected that a molding process would require some amount of additional machining to provide a useable thread.

The integral design and cast method of production facilitates production of the yoke members 16, eliminating all requirements for machining and/or stamping. The integral design also provides superior conductive characteristics since it eliminates the possibility of the formation of a high impedance joint. The all zinc alloy construction eliminates the use of all brass, resulting in lower material costs. The combination of the integral cast structure and all zinc alloy material provides a ground connector having a greatly reduced unit cost compared that of conventional products. Preferably, the yoke member 16 is composed of ZA-8 zinc alloy for mechanical strength. The copper/tin plate provides superior corrosion resistance and compatibility with various shielding alloys.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A cable shield ground clamp for cable having an outer jacket and an interiorly disposed shield, said clamp comprising:

an integral, one-piece molded yoke member having a generally U-shaped yoke section having a pair of generally parallel legs, said legs having opposed molded thread surfaces, a ground connection section for connecting said yoke section with a ground connector, and a strain relief section mountable to the cable jacket; and keeper means mounted to said yoke member, said keeper means comprising driver means and clamp jaw means disposed between said legs, said driver means being threadably engageable with said yoke section thread surfaces for variable positioning said clamp jaw means therealong and for maintaining the position of said clamp jaw means at a selected fixed position relative to said yoke section.

2. The cable shield clamp of claim 1 wherein said ground connection section comprises an arm laterally extending from said yoke section, said arm and said yoke section each defining an axis wherein said axis of said arm is substantially perpendicular to said axis of said yoke section.

3. The cable shield clamp of claim 2 wherein said arm comprises a distal portion and an intermediate portion disposed intermediate said distal portion and said yoke section, said distal portion having a laterally extending slot.

4. The cable shield clamp of claim 3 wherein said distal portion and said intermediate portion each have a thickness, wherein said thickness of said intermediate portion is greater than said thickness of said distal portion.

5. The cable shield clamp of claim 1 wherein said strain relief section comprises a shelf laterally extending to a distal end portion, said distal end portion extending longitudinally to define a shoulder.

6. The cable shield clamp of claim 5 further comprising engagement means for engaging said shelf of said relief section and the outer jacket of the cable, whereby the cable is mounted to the strain relief section and forces imposed on the cable by said cable shield clamp are imposed on the jacket of the cable.

7. The cable shield clamp of claim 6 wherein said engagement means comprises electrical tape.

8. The cable shield clamp of claim 6 wherein said engagement means comprises a tie-wrap.

9. The cable shield clamp of claim 1 wherein said yoke member is composed of zinc alloy.

10. A cable shield ground clamp for a cable having a conductive shield surrounded by an outer jacket, the clamp comprising:

an integral, one-piece, molded yoke member having a generally U-shaped yoke section having a pair of generally parallel legs and defining a receiving aperture, said legs having opposed molded thread surfaces;

a ground connection section having means for connecting said yoke section with a ground connector, and a strain relief section;

keeper means mounted to said yoke member, said keeper means comprising driver means and clamp jaw means disposed between said legs, said driver means being threadably engageable with said yoke thread surfaces for variable positioning said clamp jaw means therealong and for maintaining the position of said clamp jaw means at a selected fixed position relative to said yoke section, said clamp jaw means being engageable with the conductive shield of a cable received within said receiving aperture; and mounting means engageable with said strain relief section and the outer jacket of the cable for mounting the yoke member to the outer jacket, whereby forces imposed on the cable by said cable shield ground clamp are preferentially imposed on the outer jacket of the cable.

11. The cable shield clamp of claim 10 wherein said ground connection section comprises a distal portion and wherein said means for connecting said yoke section with a ground connector comprises a slot disposed in said distal portion.

12. The cable shield clamp of claim 10 wherein said yoke section further comprises a bight having an inner surface, said ground connection section has a surface adjacent said inner surface of said bight, and said yoke member defines a U-shaped recess laterally traversing said inner surface of said bight and at least a portion of said adjacent surface of said ground connection section.

13. The cable shield clamp of claim 10 wherein said strain relief section comprises a shelf laterally extending to a distal end portion, said distal end portion extending longitudinally to define a shoulder.

14. A cable shield ground clamp assembly comprising:

a cable comprising at least one conductor, an outer jacket, and a conductive shield intermediate said conductor and said jacket;

an integral, one-piece, molded yoke member having a generally U-shaped yoke section having a pair of generally parallel legs and defining a receiving aperture for receiving said conductor and said shield, said legs having opposed thread surfaces;

a ground connection section extending laterally from said yoke section having means for connecting said yoke section with a ground connector, and a strain relief section extending laterally from said yoke section;

keeper means mounted to said yoke member, said keeper means comprising driver means and clamp jaw means disposed between said legs, said driver means being threadably engageable with said yoke thread surfaces for variable positioning said clamp jaw means therealong and for maintaining the position of said clamp jaw means at a selected fixed position relative to said yoke section, wherein said clamp jaw means engages said conductive shield; and mounting means engaged with said strain relief section and said outer jacket for mounting the yoke member to the outer jacket, whereby forces imposed on said cable by said cable shield ground clamp are preferentially imposed on said outer jacket.

15. The cable shield clamp assembly of claim 14 wherein said keeper means engages said cable shield at a first position and said mounting means engages said cable jacket at a second position which is longitudinally spaced from said first position.

16. The cable shield clamp assembly of claim 14 wherein said yoke section further comprises a bight having an inner surface, said ground connection section has a surface adjacent said inner surface of said bight, and said yoke member defines a U-shaped recess laterally traversing said inner surface of said bight and at least a portion of said adjacent surface of said ground connection section for receiving said shield.

17. The cable shield clamp assembly of claim 14 wherein said ground connection section comprises a distal portion and wherein said means for connecting said yoke section with a ground connector comprises a slot disposed in said distal portion.

18. The cable shield clamp assembly of claim 14 wherein said strain relief section comprises a shelf laterally extending to a distal end portion, said distal end portion extending longitudinally to define a shoulder, wherein said mounting means engages said shelf and said distal end portion retains said mounting means on said shelf.

19. A cable shield ground clamp for cable having an outer jacket and an interiorly disposed shield, said clamp comprising:

an integral, one-piece, molded yoke member having a generally U-shaped yoke section having a bight and a pair of generally parallel legs, said legs having opposed molded thread surfaces, said bight having an inner surface defining a laterally extending U-shaped recess;

a ground connection section for connecting said yoke section with a ground connector, said ground connection section comprising an arm laterally extending from said yoke section, said arm having a distal portion and an intermediate portion disposed intermediate said distal portion and said yoke section, said distal portion having a laterally extending slot, said intermediate portion having a surface adjacent said inner surface of said bight, said U-shaped recess of said inner surface of said bight laterally traversing at least a portion of said adjacent surface of said intermediate portion; and a strain relief section mountable to the cable jacket; and keeper means mounted to said yoke member, said keeper means comprising driver means and clamp jaw means disposed between said legs, said driver means being threadably engageable with said yoke section thread surfaces for variable positioning said clamp jaw means therealong and for maintaining the position of said clamp jaw means at a selected fixed position relative to said yoke section.

* * * * *